US006615558B2

(12) United States Patent
Libby et al.

(10) Patent No.: US 6,615,558 B2
(45) Date of Patent: Sep. 9, 2003

(54) DOOR AND SIDELIGHTS WITH VISUALLY MATCHING CURVES

(75) Inventors: James Brian Libby, Stillwater, MN (US); Casey L. Carlson, Edina, MN (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 09/903,430

(22) Filed: Jul. 11, 2001

(65) Prior Publication Data

US 2003/0009968 A1 Jan. 16, 2003

(51) Int. Cl.[7] ..... E06B 3/66

(52) U.S. Cl. ..... 52/455; 52/311.1; 52/311.2; 52/204.59

(58) Field of Search ..... 52/311.1, 311.2, 52/211, 204.59, 455; D25/103, 52, 105, 48

(56) References Cited

U.S. PATENT DOCUMENTS

| | | | | | |
|---|---|---|---|---|---|
| 524,714 | A | | 8/1894 | Graves | |
| 1,619,631 | A | * | 3/1927 | Patasnik | 52/204.62 |
| 2,094,294 | A | * | 9/1937 | Garritsen | 52/456 |
| D192,073 | S | | 1/1962 | Jackson | |
| D245,265 | S | | 8/1977 | Andresen | |
| D265,931 | S | * | 8/1982 | Simpson | D25/48 |
| D265,933 | S | * | 8/1982 | Simpson | D25/48 |
| D270,668 | S | | 9/1983 | Shaffer et al. | |
| D312,505 | S | * | 11/1990 | Guetle, Jr. et al. | D25/103 |
| D313,855 | S | * | 1/1991 | Hall | D25/103 |
| 5,022,206 | A | | 6/1991 | Schield et al. | |
| 5,131,199 | A | | 7/1992 | Clark | |
| 5,822,923 | A | | 10/1998 | Governale | |
| 5,834,124 | A | * | 11/1998 | Pease et al. | 156/106 |
| D404,145 | S | * | 1/1999 | Fisher | D25/103 |
| D417,013 | S | * | 11/1999 | Gatch | D25/105 |
| 6,185,883 | B1 | * | 2/2001 | Howard | 362/145 |

OTHER PUBLICATIONS

Brochure entitled "Legacy Series. A Wonderful First Impression That Lasts!", Wayne Dalton, 2 pgs. (©1995).

Brochure entitled "Peachtree Insulated Sliding & Swinging Doors", *Delmarva Sash & Door Co.*, 3 pgs (©1981).

Libby et al., patent application entitled "Entryway Unit Portion Design", Ser. No. 29/144,834, 11 pgs., filed Jul. 11, 2001 in the U.S. patent and Trademark Office.

Picture of door "A", believed to have been seen at least as early as National Home Builders Association (NAHB Show Feb. 9, 2001).

Picture of doors "B", believed to have been in a catalog as early as 1999.

Picture of door "C", believed to have been seen at least as early as Oct. 2001.

Picture of door "D", believed to have been seen at least as early as National Home Builders Association (NAHB Show Feb. 9, 2001).

Picture of door "E", believed to have been seen at least as early as National Home Builders Association (NAHB Show Feb. 9, 2001).

Picture of door "F", believed to have been seen at least as early as National Home Builders Association (NAHB Show Feb. 9, 2001).

(List continued on next page.)

*Primary Examiner*—Carl D. Friedman
*Assistant Examiner*—Basil Katcheves
(74) *Attorney, Agent, or Firm*—Womble Carlyle Sandridge & Rice PLLC

(57) ABSTRACT

Signature entryway units combine common non-circular elements to form an entryway unit that suggests a circle. The entryway unit can include a door and one or more sidelight panels. The non-circular elements can include glazing units.

19 Claims, 8 Drawing Sheets

OTHER PUBLICATIONS

Picture of door "G", believed to have been seen at least as early as National Home Builders Association (NAHB Show Feb. 9, 2001).

Picture of door "H", believed to have been seen at least as early as National Home Builders Association (NAHB Show Feb. 9, 2001).

Picture of door "I", believed to have been seen at least as early as National Home Builders Association (NAHB Show Feb. 9, 2001).

Picture of door "J", believed to have been seen at least as early as National Home Builders Association (NAHB Show Feb. 9, 2001).

Picture of door "K", believed to have been seen at least as early as National Home Builders Association (NAHB Show Feb. 9, 2001).

Picture of doors "L", believed to have been seen at least as early as National Home Builders Association (NAHB Show Feb. 9, 2001).

Picture of doors "M", believed to have been seen at least as early as National Home Builders Association (NAHB Show Feb. 9, 2001).

* cited by examiner

DOOR AND SIDELIGHTS WITH VISUALLY MATCHING CURVES

TECHNICAL FIELD

The invention relates generally to entryway units and more specifically to entryway units that combine a door with sidelights. In particular, the invention relates to entryway units that combine a door having a curved glazing unit with sidelights having complementary curved glazing units.

BACKGROUND

Entryway units combine a door with one or more sidelight panels. This can form the illusion of a larger door, which can be considered as more attractive than a smaller entryway unit having only a door. In particular, entryway units that are formed by combining a door with two sidelight panels, one on each side of the door, are considered to be particularly attractive.

Entryway units can be manufactured using a stock selection of doors, sidelight panels and glazing units. Door and sidelight panels can be rectangular and can include a variety of stamped or embossed patterns. In particular, door and sidelight panels can incorporate square and rectangular patterns. Glazing units can be square or rectangular to complement the rectilinear patterns stamped or embossed into the door or sidelight panel.

The circle is considered to be a highly desirable design element. There have been attempts to incorporate the circle into an entryway unit. This includes doors having circular glazing units. Other previous attempts have included entryway units having angled units with angled edges in both the door and in each of the sidelight panels.

SUMMARY

The present invention is directed to entryway units that combine non-circular elements to form an entryway unit that suggests a circle. The entryway unit can include a door and one or more sidelight panels. The non-circular elements can include glazing units.

Accordingly, an embodiment of the present invention is found in an entryway unit that includes a first sidelight panel having a first glazing unit that has a curved edge with a first radius of curvature, a second sidelight panel having a second glazing unit that has a curved edge with a second radius of curvature, and a door located between the first and second sidelight panels. The door includes a third glazing unit that has a curved edge with a third radius of curvature.

The curved edges of the first and second glazing units together define in part a first circle and the curved edge of the third glazing unit defines in part a second circle. A larger of the first circle and the second circle has a diameter that is within about 200% of a diameter of a smaller of the first circle and the second circle. One of the first and second circles lies within the other of the first and second circles, and the diameter of the first circle and the diameter of the second circle are each less than a width of the entryway unit. An uppermost point of the first circle is within several inches of an uppermost point of the second circle.

Another embodiment of the present invention can be found in an entryway unit that includes a first sidelight panel having a first sidelight panel glazing unit, a second sidelight panel having a second sidelight panel glazing unit and a door having a door glazing unit, the door being arranged between the first sidelight panel and the second sidelight panel. The first sidelight panel glazing unit, the second sidelight panel glazing unit and the door glazing unit can each have a curved edge, with the curved edges appearing to lie on a single circle that has a diameter that is less than a width of the entryway unit.

Other features and advantages of the present invention will be apparent from the following detailed description and drawings.

DETAILED DESCRIPTION

Entryway units can be formed by combining a door with one or more sidelight panels and elements of the entryway unit visually suggest a circle. For example, non-circular elements such as glazing units having curved edges may be used to create an impression of a circle.

Figure 1:
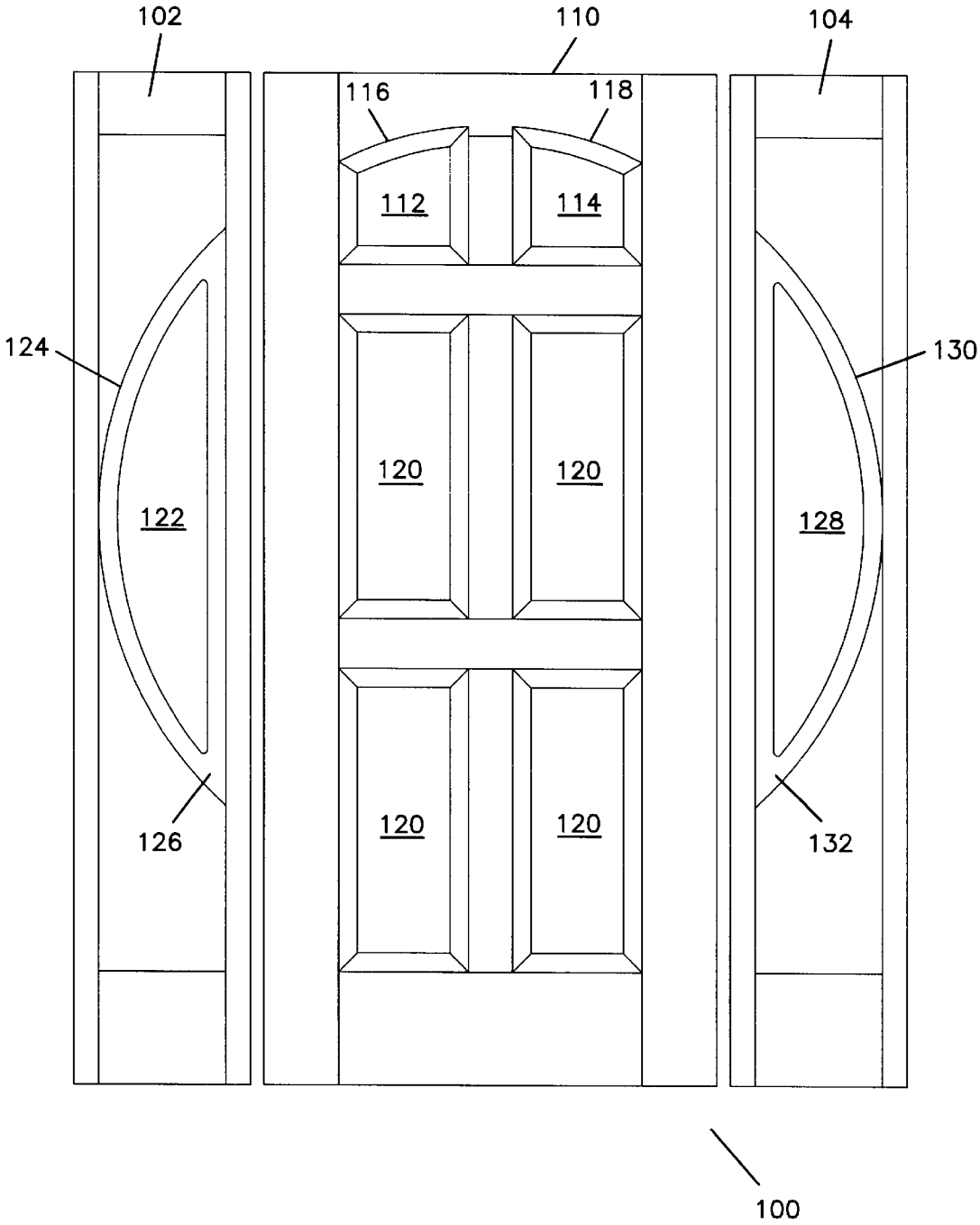
FIG. 1 illustrates an entryway unit in accordance with an embodiment of the present invention.

As illustrated for example in FIG. 1, an entryway unit 100 includes a door 110 having glazing units 112 and 114 with curved edges 116 and 118, respectively. The unit 100 also includes a first sidelight panel 102 that flanks one side of the door 110 and has a first glazing unit 122 that has a curved edge 124. A second sidelight panel 104 flanks the other side of the door 110 and has a second glazing unit 128 has a curved edge 130. Each glazing unit 122, 128 has a width that is constrained by the overall width of the sidelight panel 102, 104 and by the radius of curvature. Many of these elements are illustrated in the other FIGURES as well, where identical reference numbers indicate identical components. The curved edges 124, 116, 118, 130 of the first glazing unit 122, second glazing unit 128, and third glazing units 112, 114 appear to lie along a single circle. As a result, the impression of a circle is inscribed within and spans the rectangular opening of the entryway unit 100. This impression is visually unique and is recognizable from a distance.

FIGS. 2–8 illustrate other entryway unit embodiments where curved edges of the glazing units in the door and sidelights appear to lie on a single circle. The entryway unit 700 of FIG. 7 includes sidelights 102 and 104 as shown in FIG. 1 surrounding a door 710 having a single glazing unit 712. A curved edge 716 of the door glazing unit 712 appears to lie along the same circle as the curved edges 124, 130 of the sidelight glazing units 122, 128.

Figure 7:
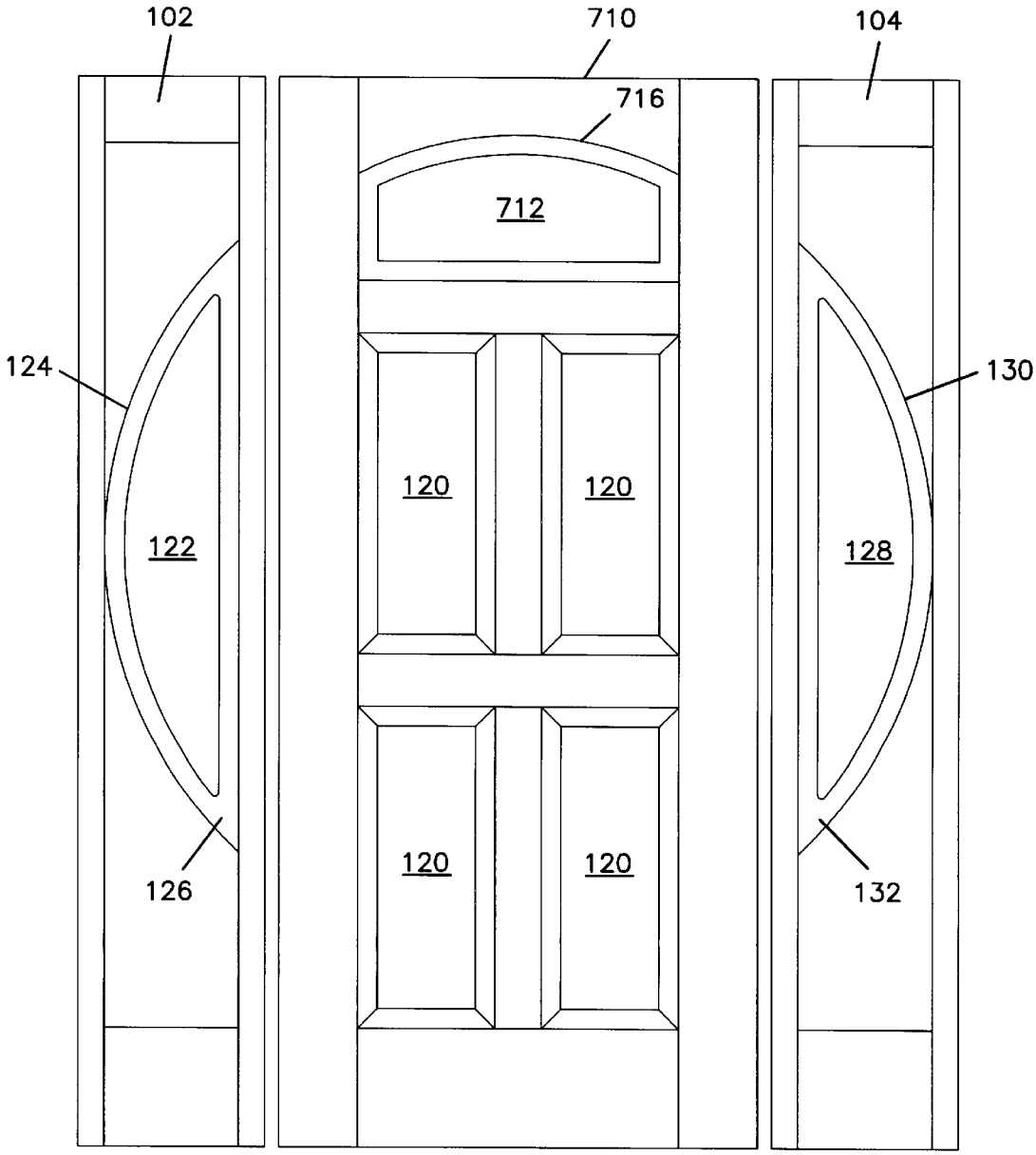
FIG. 7 illustrates an entryway unit in accordance with another embodiment of the present invention.
Figure 8:
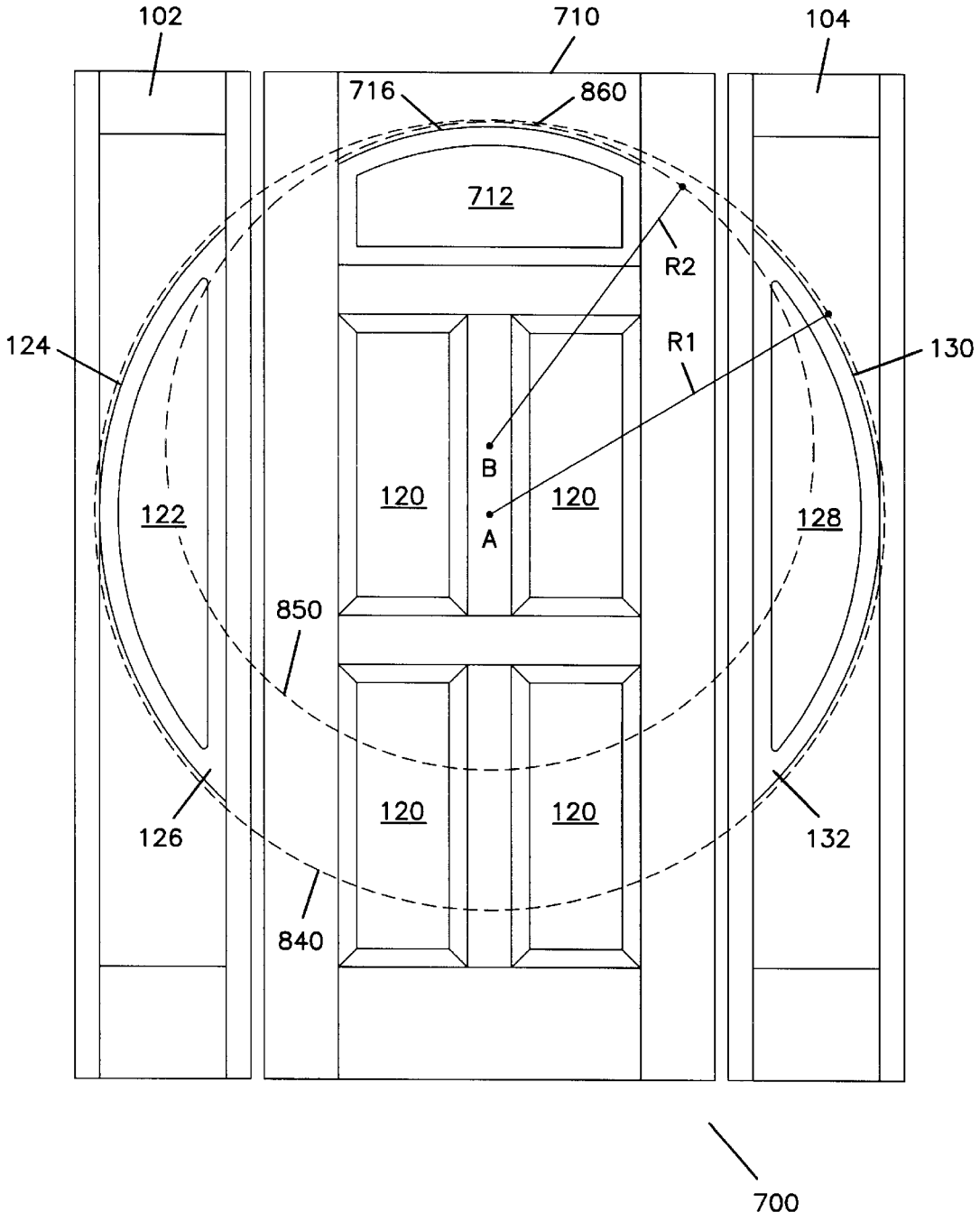
FIG. 8 illustrates the entryway unit of FIG. 7, showing the relationship between the curvatures of the door glazing unit and the sidelight panel glazing units.

The visual impression of a circle can be achieved in a number of ways. For example, all the curved edges of the various glazing units may have approximately the same radii of curvature so that the curved edges actually do lie along the same circle. However, it is also possible to use different radii of curvature to create the desired impression. FIG. 8 illustrates the entryway unit 700 of FIG. 7 but includes dashed lines to extend the curved edges of the glazing units. The curved edges 124, 130 of sidelight panel glazing units 122, 128, respectively, define in part a circle 840 that has a radius R1 and a center located at point A. The curved edge 716 of the door glazing unit 712 defines in part a circle 850 having a second radius R2 and a center located at point B. The centers A and B circles 840, 850 are at least approximately horizontally centered, side to side within the door 710. The two circles 840, 850 are not the same, and do not have a common center. Nevertheless, when combined as illustrated, the two circles 840, 850 visually suggest a complete circle within the entryway unit 700. FIG. 8 is illustrative only and is not intended to limit the geometry of the entryway units in accordance with the present invention. One of skill in the art will recognize that the particular locations of the centers of each circle, as well as their respective radii, can vary as a function of the particular door, sidelight panels and glazing units selected.

Each glazing unit 122, 128 within the sidelight panels 102, 104 has a curved edge 124, 130 that has a radius of curvature that is sufficiently close to the radius of curvature of a curved edge of a door glazing unit so that in combination, the glazing unit in the door and the glazing units 122, 128 within each sidelight panel 102, 104 suggest a circle. To form the illusion of a complete circle within the entryway unit 800, it is preferred that the diameters of the circles 840, 850 be within about 200% of each other. In some embodiments, the circles will be within about 130% of each other. In other embodiments, the diameters of the circles will be within about 120% of each other.

An example of dimensions that may be used for one embodiment are that the circle 840 defining the curved edges 124, 130 of the sidelight glazing units 122, 128 may have a radius of about 31 inches while the circle 850 defining the curved edges 716 of the door glazing unit 712 may have a radius of about 26 inches, where the door 710 has a width of about 36 inches and each sidelight 102, 104 has a width of about 14 inches. Of course, the dimensions of this one particular embodiment are illustrative and many other embodiments also are possible that achieve the visual impression of a circle.

In the embodiment illustrated in FIG. 8, the radius of curvature of the curved edge 716 of the door glazing unit 712 is less than the radii of curvature of the curved edges 124, 130 of the sidelight panel glazing units 122, 128. The smaller radius of curvature of the door glazing unit 712 can heighten the visual effect of combining the door and sidelight panel elements to suggest a circle.

It is also possible to provide a larger radius of curvature for the door glazing unit than for the sidelight glazing units. For example, a circle defined in part by the curved edges of the sidelight glazing units may have a radius of about 26 inches while a circle defined in part by the curved edges of the door glazing unit may have a radius of about 48 inches, where the door has a width of about 36 inches and each sidelight has a width of about 14 inches each. In another embodiment the circle 850 has a radius of about 60 inches and circle 840 has a radius of about 26 inches, 31 inches, 48 inches, or 60 inches, for a door width of about 36 inches or other sizes. Of course, these dimensions will vary depending on the width of the door and sidelight panels in question.

It is also preferred that the curved edges of the sidelights appear to smoothly continue the curved edge or edges of the door glazing unit. As a result, it is preferred that the two circles 840, 850 share a common point, preferably at or near the top of the two circles 840, 850 at an uppermost point 860. If the two circles 840, 850 do not actually touch at point 860, it is preferred that the two circles 840, 850 each have an apex that is within about several inches of each other, more preferably within two or three inches of each other. It is also preferred that each of circles 840, 850 have diameters that are less than the width of the entryway unit 700.

Each of the sidelight panel glazing units 122, 128 have a lower end 126, 132 that preferably extends downward beyond a center point of the circle 840 defined in part by the curved edges 124, 130 of the sidelight panel glazing units 122, 128. This is particularly illustrated in FIG. 8, in which lower ends 126, 132 clearly extend downward well beyond either point A or point B. The extension of the curved edges of the sidelight glazing units vertically beyond the center of the circle strengths the visual impression of a circle.

Each door in FIGS. 1–8 has at least one glazing unit. Variations in the glazing unit or glazing units provided in the door of the entryway unit are possible. A door 210 shown in FIG. 2 has a single glazing unit 210 with a curved edge 216 that is sized to horizontally span a significant portion of the door 210 and extend vertically further than the glazing units shown in FIGS. 1 and 7. A door 310 shown in FIG. 3 has a glazing unit 312 with a curved edge 316 that is sized to horizontally span a significant portion of the door 310 and extend vertically further than the glazing units shown in FIGS. 1, 2 and 7, to about the middle of the door. A door 410 shown in FIG. 4 includes the glazing unit 316. A door 510 shown in FIG. 5 includes two glazing units 512 and 514 having curved edges 516, 518, respectively. The glazing units 516, 518 are mirror images of each other, and extend vertically to near the middle of the door. The door 610 includes the glazing units 516, 518.

Figure 5:
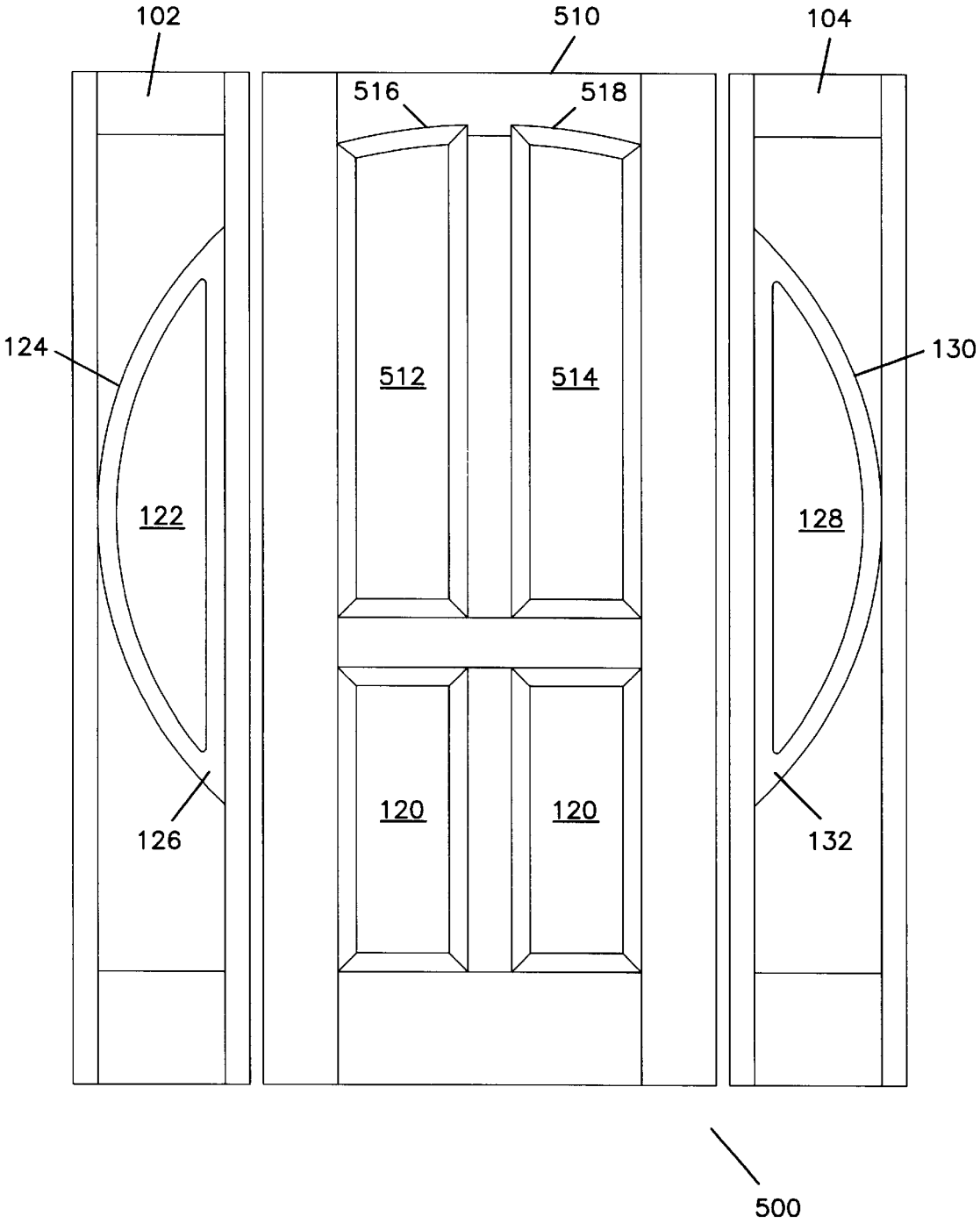
FIG. 5 illustrates an entryway unit in accordance with another embodiment of the present invention.
Figure 6:
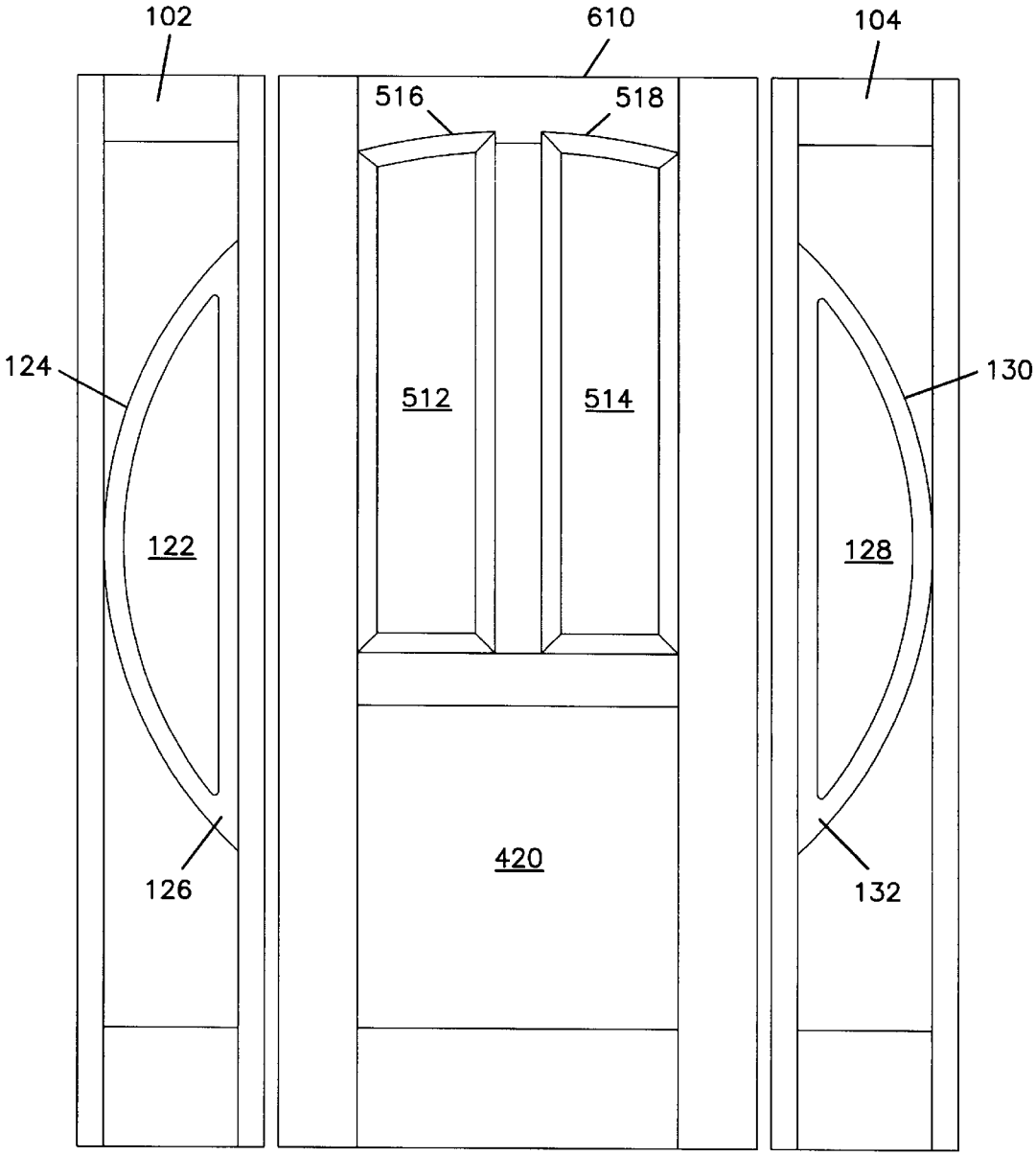
FIG. 6 illustrates an entryway unit in accordance with another embodiment of the present invention.

If two glazing units 112, 114, 512, 514 are present side-by-side, as illustrated for example in FIGS. 1, 5 and 6, the first glazing unit 112, 512 and the second glazing unit 114, 514 can have the same radius of curvature. Alternatively, the first glazing unit 112, 512 and the second glazing unit 114, 514 can have radii of curvature that vary somewhat. Depending on their exact positioning within the door 110, 510, 610, it may be beneficial to vary the respective radii of curvature somewhat to better suggest the appearance of a circle. If the two radii of curvature do vary from one another, they can vary within about ten percent of each other.

Doors can be provided in a variety of different widths. While a width of 36 inches is preferred, doors can be provided in widths that include about 30 inches, 32 inches, 34 inches and 48 inches. Similarly, sidelight panels can be provided in a variety of widths, such as about 10 inches, 12 inches, 14 inches and 24 inches.

The doors and sidelight panels used in forming entryway units can be formed from a variety of materials, including wood, steel, fiberglass and various composite materials. The doors may be slab doors, or may be made using other types of door contructions. When slab doors are manufactured, typically, a door or sidelight panel slab is formed with a predetermined pattern stamped or embossed into at least one surface of the slab. Once the door or sidelight panel slab has been patterned, any openings necessary for glazing units can be cut. Alternatively, the glazing unit openings can be cut prior to forming the pattern, or can be cut in portions of the door or panel that were left un-patterned.

Steel and fiberglass doors are frequently manufactured by forming two skins that are patterned and insulated. Doors can also be formed through a more traditional rail and stile construction technique in which individual components are formed and then joined to form the door. The individual components can be formed from wood, or can be extruded in a plastic or a composite material that includes a plastic with a reinforcing fiber or material of some sort. A preferred composite material includes a thermoplastic that incorporates wood fibers. Examples of preferred composite materials are available publicly under the FIBREX® tradename.

In a door or sidelight panel made from assembling individual components, the joints between components can be visible. These joints can be simulated in a door or sidelight panel that is made by combining two skins. Whether or not to show or simulate these joints is largely a design issue.

Once the door and sidelight panels have been manufactured, they can be combined into an entryway unit. Typically, the door will be placed within a frame and will be hingedly attached to one side of the frame. The frame will extend to surround the sidelight panels as well. Individual frame members can be made from wood, steel, aluminum or can be extruded or otherwise formed from a variety of plastic and composite materials. The individual frame members can be sized to fit a particular rough opening and typically range from about 2 to about 5 inches in width. The frame members can have a depth that corresponds to a thickness of a wall in which the entryway unit will subsequently be installed. In home construction, for example, the individual frame members can be sized to fit within either a 2×4 or a 2×6 stud wall.

The door can be a simple planar door, or it can include a pattern that is stamped, embossed or otherwise formed in or on at least one surface of the door. Similarly, sidelight panels can be simple in design or can, like doors, include a decorative pattern that is formed in or on at least one surface of the sidelight panel. One of the more common designs for a door is the six panel door. One or more of the six panels can be replaced with or otherwise formed as a glazing unit, or window. FIG. 1 illustrates a door 110 in which the two uppermost panels have been expressed as glazing units 112 and 114. The door 110 retains four stamped or embossed panels 120. FIG. 5 is similar, but has larger glazing units 512 and 514 and thus has only two stamped or embossed panels 120.

Figure 2:
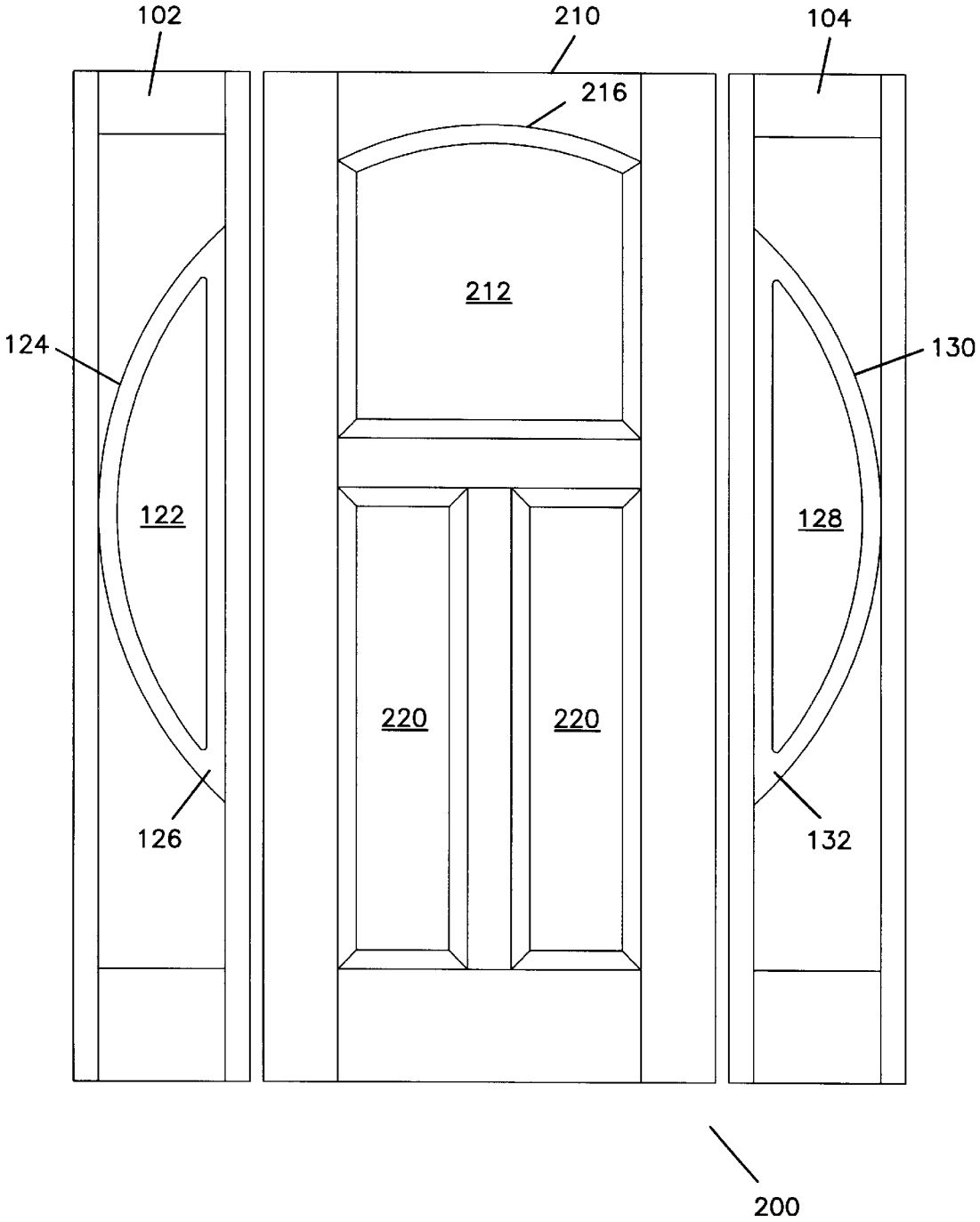
FIG. 2 illustrates an entryway unit in accordance with another embodiment of the present invention.
Figure 3:
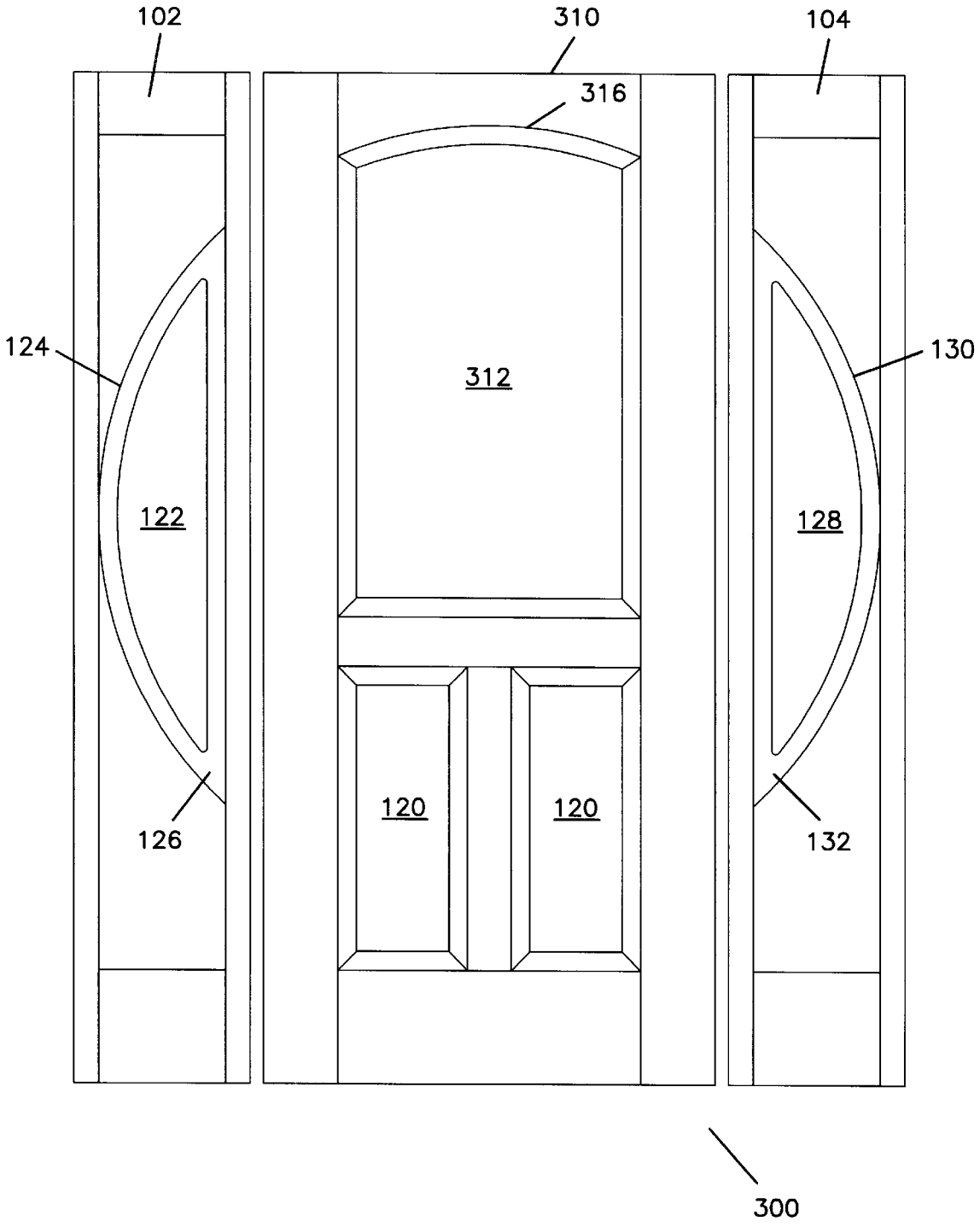
FIG. 3 illustrates an entryway unit in accordance with another embodiment of the present invention.
Figure 4:
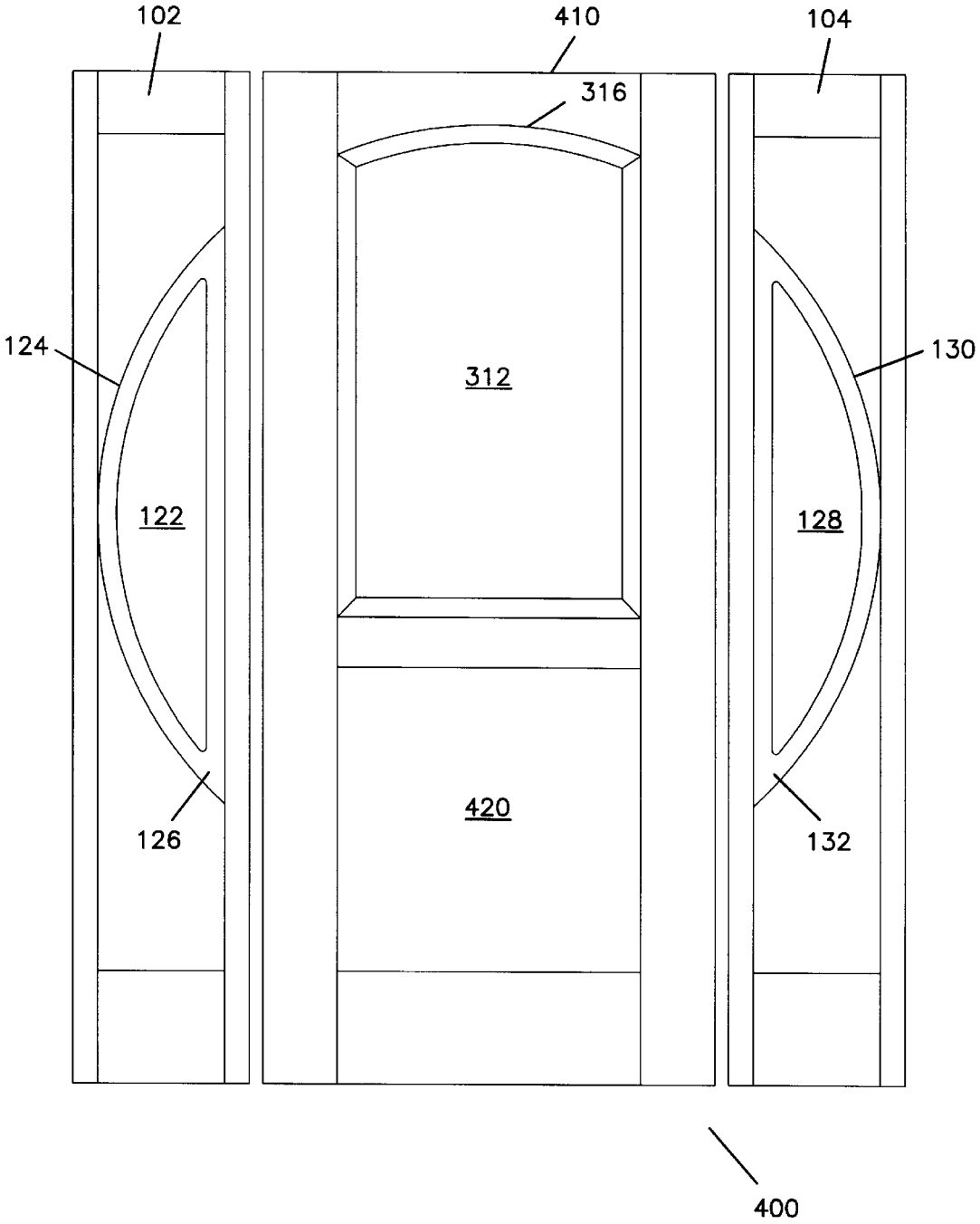
FIG. 4 illustrates an entryway unit in accordance with another embodiment of the present invention.

FIGS. 2 and 3 illustrate doors 210, 310 in which an upper panel has been expressed as a single glazing unit 212, 312 of varying length. Doors 210, 310 each have two stamped or embossed panels 220, 120, respectively, that vary in length to accommodate the length of the corresponding glazing units 212, 312. FIGS. 7 and 8 show a door 710, 810 with a single glazing unit 712 and four raised or stamped panels 120.

It should be noted that while panels 120, 220 are presented in the FIGURES as having particular size and proportions, one of skill in the art will recognize that the panels 120, 220 are not limited to these illustrated renditions. Rather, the panels 120, 220 can be resized and reshaped in accordance with any particular design requirements and preferences.

Moreover, it is not necessary for the door 410, 610 to include a panel design that is formed in or on at least one surface of the door 410, 610. Instead, the door 410, 610 can also present a smooth, unbroken surface 420. This is illustrated, for example, in FIGS. 4 and 6, which show doors 410, 610 having one large glazing unit 312 and two thinner glazing units 512, 514, respectively.

The doors illustrated herein also include rail and stile features which may or may not be present in any embodiment, as dictated by design preferences and by the particular construction technique.

Designs for portions of entryway units that relate to the present patent application are described in a co-pending U.S. Design Patent Application filed on the even date herewith, having attorney docket number 9340.921US01, titled ENTRYWAY UNIT PORTION DESIGN, assigned to the same assignee as the present application, which is hereby incorporated herein by reference in its entirety.

While the invention has been described with reference to specific embodiments, it will be apparent to those skilled in the art that many alternatives, modifications and variations may be made. Accordingly, the present invention is intended to embrace all such alternatives, modifications and variations that may fall within the spirit and scope of the appended claims.

We claim:

1. An entryway unit comprising:

a first sidelight panel comprising a first glazing unit having a curved edge with a first radius of curvature;

a second sidelight panel comprising a second glazing unit having a curved edge with a second radius of curvature; and a door between the first and second sidelight panels, the door comprising a third glazing unit having a curved edge with a third radius of curvature;

wherein the curved edges of the first and second glazing units together define in part a first circle and the curved edge of the third glazing unit defines in part a second circle; and wherein a larger of the first circle and the second circle has a diameter that is within about 200% of a diameter of a smaller of the first circle and the second circle, one of the first and second circles lies within the other of the first and second circles, the diameter of the first circle and the diameter of the second circle are each less than a width of the entryway unit, and an uppermost point of the first circle is within several inches of an uppermost point of the second circle.

2. The entryway unit of claim 1, wherein the curved edges of the glazing units visually suggest a circle.

3. The entryway unit of claim 1, wherein the first circle has a center that is horizontally centered within the door.

4. The entryway unit of claim 3, wherein the curved edges of the first and second glazing units extend downward beyond the center of the first circle.

5. The entryway unit of claim 1, wherein the third radius of curvature is less than either the first radius of curvature or the second radius of curvature.

6. The entryway unit of claim 1, wherein the second circle has a center that is horizontally centered within the door.

7. The entryway unit of claim 6, wherein the third glazing unit extends downward beyond the center of the second circle.

8. The entryway unit of claim 1, wherein the third curved glazing unit comprises a pair of complementary curved glazing units, each of the pair of glazing units having a curved edge having the third radius of curvature.

9. The entryway unit of claim 1, wherein the first radius of curvature and the second radius of curvature are each about 31 inches, the third radius of curvature is about 26 inches, and a width of the door is about 36 inches.

10. An entryway unit comprising:

a first sidelight panel comprising a first glazing unit;

a second sidelight panel comprising a second glazing unit; and a door comprising a third glazing unit, the door being arranged between the first sidelight panel and the second sidelight panel;

wherein the first glazing unit, the second glazing unit and the third glazing unit each have a curved edge and the curved edges appear to lie on a single circle that has a diameter that is less than a width of the entryway unit.

11. The entryway unit of claim 10 wherein the curved edges of the first and second glazing units together define in part a first circle and the curved edge of the third glazing unit defines in part a second circle, wherein a larger of the first circle and the second circle has a diameter that is within about 200% of a diameter of a smaller of the first circle and the second circle, one of the first and second circles lies within the other of the first and second circles, the diameter of the first circle and the diameter of the second circle are each less than a width of the entryway unit.

12. The entryway unit of claim 11 wherein an uppermost point of the first circle is within several inches of an uppermost point of the second circle.

13. The entryway unit of claim 12 wherein an uppermost point of the first circle is within two inches of an uppermost point of the second circle.

14. The entryway unit of claim 11, wherein the first circle has a center that is horizontally centered within the door.

15. The entryway unit of claim 11, wherein the curved edges of the first and second glazing units extend downward beyond the center of the first circle.

16. The entryway unit of claim 10, wherein the diameter of the second circle is less than the diameter of the first circle.

17. The entryway unit of claim 10, wherein the second circle has a center that is horizontally centered within the door.

18. The entryway unit of claim 10, wherein the third glazing unit extends downward beyond the center of the second circle.

19. The entryway unit of claim 10, wherein the third curved glazing unit comprises a pair of complementary curved glazing units, each of the pair of glazing units having a curved edge having the third radius of curvature.

* * * * *